US005203818A

United States Patent [19]

Kuiper

[11] Patent Number: 5,203,818

[45] Date of Patent: Apr. 20, 1993

[54] SUSPENSION HOOK

[76] Inventor: Karel Kuiper, Stationslaan 52, 8071 CN Nunspeet, Netherlands

[21] Appl. No.: 787,625

[22] Filed: Nov. 4, 1991

[51] Int. Cl.[5] ..... E04B 9/12; E04B 9/18

[52] U.S. Cl. ..... 52/484; 52/488

[58] Field of Search ..... 52/484, 488, 489, 485, 52/486, 487, 474, 665

[56] References Cited

U.S. PATENT DOCUMENTS

| | | | |
|---|---|---|---|
| 1,709,047 | 4/1929 | Walper | 52/484 |
| 1,861,615 | 6/1932 | Venzie | 52/484 |
| 3,110,373 | 11/1963 | Adams | 52/489 |
| 3,602,473 | 8/1971 | Van Riet et al. | 52/484 |
| 3,778,947 | 12/1973 | Sauer | 52/484 |
| 4,665,674 | 5/1987 | Brugman | 52/488 |
| 4,827,687 | 5/1989 | Frawley | 52/484 |
| 4,848,054 | 7/1989 | Blitzer et al. | 52/484 |
| 5,076,036 | 12/1991 | Kuiper | 52/484 |

*Primary Examiner*—Richard E. Chilcot, Jr.
*Assistant Examiner*—Michele A. Van Patten
*Attorney, Agent, or Firm*—Edmund M. Jaskiewicz

[57] ABSTRACT

Suspension hook, in particularly for suspending sectional bars from an existing ceiling, said bars together forming a grid for supporting ceiling panels. Said bars each have an upper tubular part. The suspension hook consists of a connecting portion and of a hook portion, said hook portion being intended to be inserted in said tubular part of the concerned sectional bar via a pair of apertures in the upper wall of said tubular part. The hook portion has a flat bearing surface which extends at about aright angle from the strip shaped connecting portion. The central region of said bearing surface is provided with a V-shaped downwardly projecting nose, the height of which corresponds with the height of the tubular part of the concerned sectional bar. The free end of the hook portion is provided with an upwards directed lip.

6 Claims, 2 Drawing Sheets

SUSPENSION HOOK

The present invention relates to a suspension hook, in particularly for suspending sectional bars from a ceiling, said bars together forming a grid for supporting ceiling panels, said bars each having an upper tubular part, said suspension hook consisting of a connecting portion and of a hook portion, the hook portion being intended to be inserted in said tubular part of the concerned sectional bar via a pair of apertures in the upper wall of said tubular part.

The sectional bars which are nowadays commercially available have in general a cross section in the shape of an inversed T, comprising a vertical central body portion which at the bottom end has in opposite directions projecting flanges for supporting the ceiling panels and at the free upper end is provided with a hollow tubular part for increasing rigidity of said sectional bars.

Such sectional bars are in general suspended from an existing ceiling by means of a hook, which is formed out of a piece metal wire having a thickness of about 4 mm, and is inserted in an aperture in the body portion. This construction has the drawback that said hooks project above the support flanges and in this way obstruct the placing of the ceiling panels.

In the European Patent Application 0 387 964 of Applicant is already propose to provide the upper wall of the hollow tubular part of the sectional bars with suitable apertures and to insert the hooks in said tubular part in the lengthwise direction of the sectional bar. In the above European Application the tubular part is for this reason slightly oblong seen in the direction of the body portion in order to enable insertion and accommodation of the hook.

However in sectional bars which are nowadays available the height of the tubular part is rather small so that there is not enough space for accommodating a hook which has enough strength for supporting the ceiling structure.

SUMMARY OF THE INVENTION

The object of the present invention is now to provide a suspension hook which easily can be accommodated in the hollow tubular part of a conventional sectional bar, said hook having enough strength for supporting the sectional bars without any risk for rupture of the upper wall of the tubular part of the sectional bars.

These objects are achieved according to the invention in that the hook portion has a flat bearing surface which extends at about a right angle from the strip shaped connecting portion, the central region of said bearing surface comprising a V-shaped depression forming a downwardly projecting nose the height of which corresponds with the height of the tubular part of the concerned sectional bar and the hook portion at the free end being provided with an upwards directed lip.

The invention is explained in greater detail with reference to the accompanying drawings, in which:

DETAILED DESCRIPTION OF THE DRAWINGS

Figure 1:
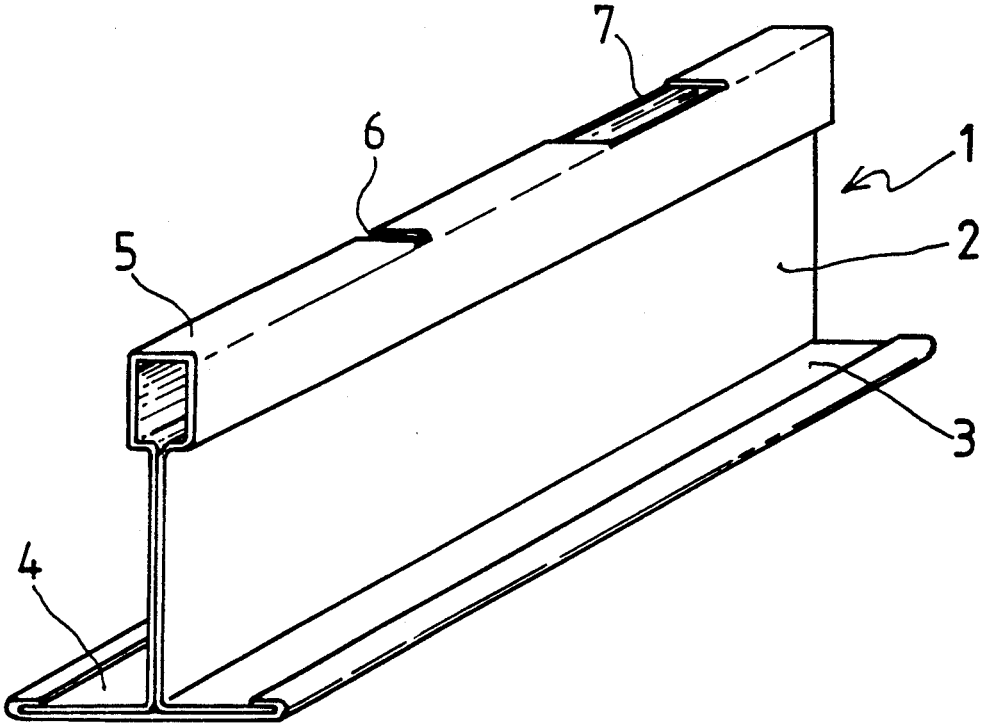
FIG. 1 shows an isometric view of a commercial available sectional bar provided with apertures for accommodating a hook according to the invention.

FIG. 1 shows a commercial available sectional bar 1, which in cross section has the shape of an inverted T. Said sectional bar consists of a vertical central body portion 2, which at the bottom end is provided with opposite projecting flanges 3 and 4 for supporting not shown ceiling panels. The body portion is at the free upper end provided with a hollow tubular part 5 for the stiffening of the sectional bar. Said tubular part has in the shown embodiment a rectangular cross section, and constitutes only a relatively small part of the whole body portion. In the upper wall of the tubular part a pair of apertures 6 and 7 are arranged for inserting a suspension hook 8 according to the invention which will be described hereafter with reference to FIG. 2. Said pairs of apertures are arranged at regular intervals along the length of each sectional bar.

Figure 2:
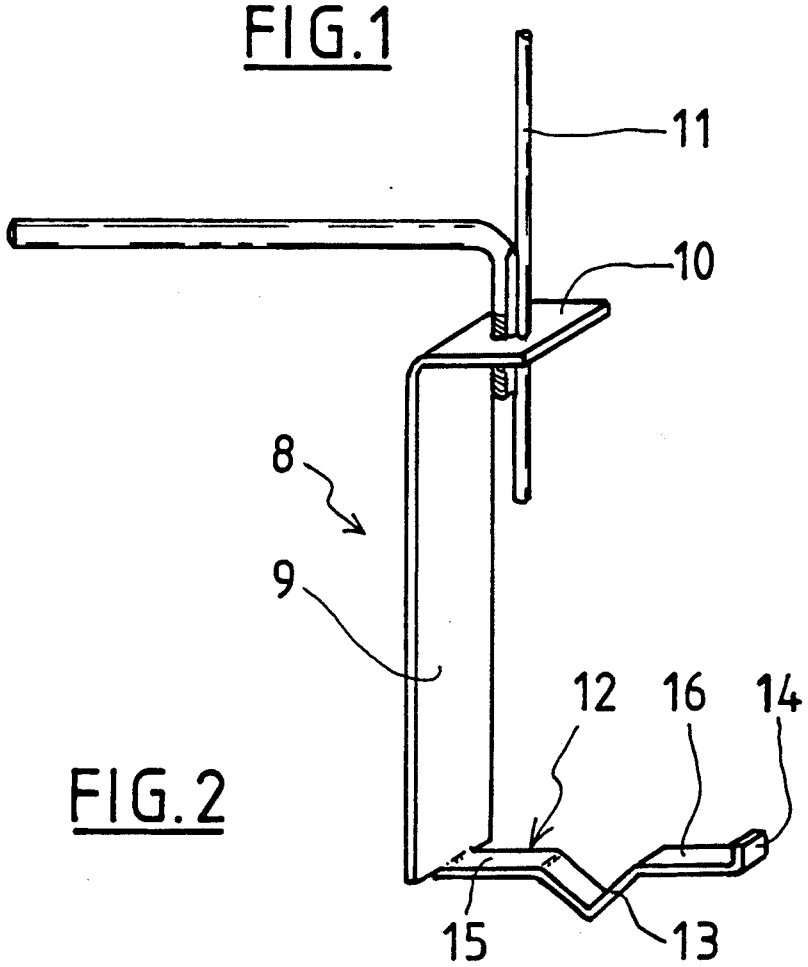
FIG. 2 shows a perspective view of a suspension hook according to the invention.

As will be seen from FIG. 2 the suspension hook is produced by bending a single strip of sheet metal and consists of a strip shaped connecting portion 9 which in the shown position at the top end has a face 10, which extend at a right angle from said connecting portion 9. Said face 10 comprises means for connecting the hook with a rod 11 which in turn is connected to an existing ceiling. Said means are already disclosed in the above mentioned European Patent Application 0387964 of Applicant and will here not be described. However it will be evident that other means could be used as well for connecting the connection portion of the hook to the rod 11.

At the bottom end the strip shaped portion 9 merges in a tongue 12 which substantially extends at right angle from said strip shaped portion 9 and constitutes the actual hook portion. Said hook portion is destined to be inserted in the tubular part 5 of the sectional bar, and has a width that corresponds with the inner width of said tubular part 5.

The tongue 12 has in its central portion a V-shaped depression, which constitutes a downwardly projecting nose 13. The free end of the tongue 12 is bend upwards for forming a small lip 14. In this way from the strip shaped portion 9 to the free end the tongue 12 contains a first bearing surface 15, the nose 13, a second bearing surface 16 and the lip 14.

Figure 3:
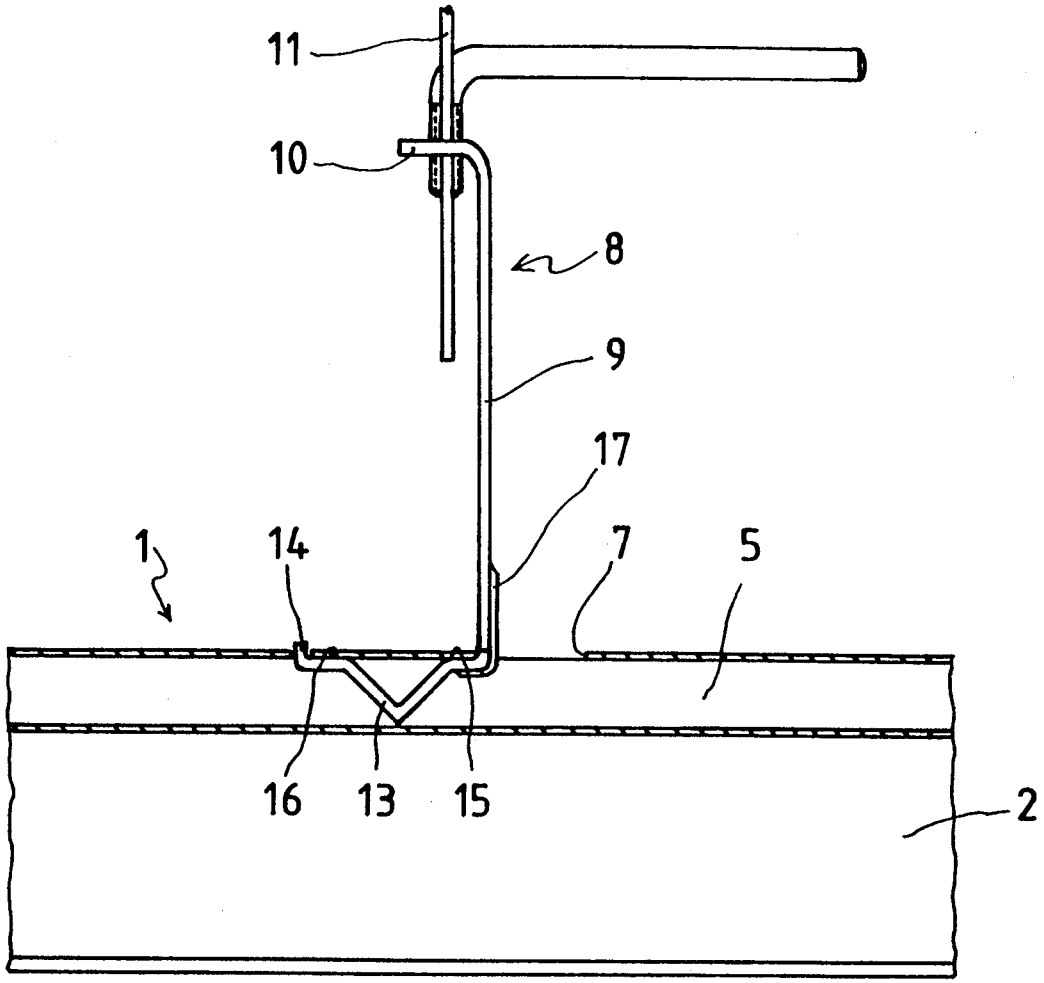
FIG. 3 shows a vertical longitudinal section of the sectional bar, in which the suspension hook of FIG. 2 has been accommodated.

The mounting of the suspension hook according to the invention will now be explained with reference to figure 3.

As clearly can be seen in FIG. 1, each pair of apertures in the upper side of the tubular part 5 of the sectional bar consists of a long aperture 7 and of a shorter aperture 6. The tongue 12 which constitutes the hook portion is inserted in the tubular part 5 via the longer aperture 7, during which the tip of the nose 13 abuts the inner bottom surface of the tubular part and the free end of the lip 14 abuts the inner upper surface of said tubular part. In this position the tongue 12 is slightly bend around the tip of the nose by its own flexibility so that the second bearing surface 16 is slightly rotated relative to the first bearing surface 15.

From the above position the suspension hook is pushed further to the left in the figure until the lip 14 engages the shorter aperture 6. In this end position the bearing surfaces 15 and 16 are aligned again and abut the inner upper surface of the tubular part, whereas the tip of the nose still abuts the inner bottom surface of said tubular part. The flexibility of the tongue 12 allows the use of a relatively flat hook portion so that the suspension hook is suitable for sectional bars having a tubular part with a limited height. Both bearing surfaces 15 and 16 provide a correct abutment of the suspension hook against the inner upper surface of the tubular part 5 so avoiding any rupture of the upper wall of the tubular part of the sectional bar. The configuration of the tongue 12 together with its flexibility provides a kind of snap connection so that the suspension hook in the mounted position is securely maintained and it is possible to insert the suspension hooks in said sectional bars before mounting said sectional bars.

The suspension hook according to the invention can easily be adapted to the different existing sectional bars by modifying the dimension of the nose.

It should be understood that the invention is not limited to the embodiment as shown and described, but that within the scope of the invention many modifications are possible.

The configuration of the nose 13 as well as the position thereof can be changed as desired.

In the shown embodiment both bearing surfaces 15 and 16 extend at right angle with the strip shaped portion 9. Said angle could eventually be somewhat lesser than 90°. The strip shaped portion could be slightly curved instead of flat in order to make the hook somewhat resilient in the vertical direction so that the hook is more resistant for seismic impacts.

The apertures 6 and 7 in the upper wall do not need to be as described but both apertures could be identical i.e. have the dimensions of aperture 7. So the upper wall of said tubular part could be provided with a series of equally spaced identical apertures.

Finally the angle portion between the strip shaped portion 9 and the tongue could be reinforced by a reinforcement rib 17.

What is claimed is:

1. A suspension hook for suspending a plurality of sectional bars forming a grid upon which ceiling panels are supported, each of said sectional bars comprising a vertical web portion having an upper end and there being a hollow tubular portion on said upper end, said hollow tubular portion having a top wall and there being a pair of apertures therein spaced along a length of said sectional bar, said suspension hook comprising a flat strip having a top end and a bottom end, said bottom end comprising a portion bent at substantially a right angle to said flat strip to define a hook portion having a flat bearing surface and a free end, there being an upwardly directed lip at said free end, said flat bearing an upwardly having a central portion with a V-shaped depression therein to define a downwardly projecting nose the height of which corresponds to the height of said hollow tubular portion of a said sectional bar, said hook being mounted to a said sectional bar when said hook portion is inserted downwardly through a said aperture such that said lip extends upwardly through said second aperture whereby the bearing surface on either side of said nose abuts the inner upper surface of said tubular portion and the tip of said nose abuts the inner bottom surface of said tubular portion.

2. Suspension hook according to claim 1 wherein the connecting portion and the hook portion are produced by bending a single strip of sheet metal.

3. Suspension hook according to claim 1 and comprising a reinforcement rib on the angle portion where the connecting portion merges in the hook portions.

4. Suspension hook according to claim 1 wherein said top end has a connecting portion for connection of the hook to an existing ceiling.

5. Suspension hook according to claim 1 wherein said pair of apertures comprise first and second apertures and said first aperture is longer than said second aperture, said hook portion being inserted into said first aperture.

6. A suspension hook according to claim 1 wherein said hook portion has a width that substantially corresponds to the inner width of said tubular portion.

* * * * *

UNITED STATES PATENT AND TRADEMARK OFFICE

CERTIFICATE OF CORRECTION

PATENT NO. : 5,203,818

DATED : April 20, 1993

INVENTOR(S) : Karel Kuiper

It is certified that error appears in the above-indentified patent and that said Letters Patent is hereby corrected as shown below:

On the title page Insert

--(30) Foreign Application Priority Data
November 8, 1990 The Netherlands (NL) 9002427--.

Signed and Sealed this

Twelfth Day of April, 1994

Bruce Lehman

*Attest:*

BRUCE LEHMAN

*Commissioner of Patents and Trademarks*

*Attesting Officer*